United States Patent [19]

Ikegawa et al.

[11] 4,443,166

[45] Apr. 17, 1984

[54] SCROLL FLUID APPARATUS WITH AN ARCUATE RECESS ADJACENT THE STATIONARY WRAP

[75] Inventors: Masato Ikegawa, Ibaraki; Kenji Tojo; Masao Shiibayashi, both of Shimizu, all of Japan

[73] Assignee: Hitachi, Ltd., Tokyo, Japan

[21] Appl. No.: 314,459

[22] Filed: Oct. 23, 1981

[30] Foreign Application Priority Data

Oct. 27, 1980 [JP] Japan ..... 55-149402

[51] Int. Cl.[3] ..... F01C 1/02; F01C 21/00

[52] U.S. Cl. ..... 418/55; 418/75

[58] Field of Search ..... 418/55, 57, 75

[56] References Cited

U.S. PATENT DOCUMENTS

| | | | |
|---|---|---|---|
| 3,884,599 | 5/1975 | Young et al. | 418/55 |
| 3,924,977 | 12/1975 | McCullough | 418/57 |
| 3,986,799 | 10/1976 | McCullough | 418/55 |
| 4,350,479 | 9/1982 | Tojo et al. | 418/57 |

*Primary Examiner*—John J. Vrablik

*Attorney, Agent, or Firm*—Antonelli, Terry & Wands

[57] ABSTRACT

A scroll fluid apparatus including two scroll members, with one scroll member having a wrap and an annular portion located outside the wrap and having a height corresponding to the height of the wrap. The annular portion is contiguous at its surface in the form of a land with the surface of the wrap for a circumferential extent of within 180 degrees from the terminating end of the wrap, and a strip-shaped recess is formed in the land, with the strip-shaped form having an end portion maintained in communication with a low pressure zone surrounded by the annular portion of the scroll member.

14 Claims, 4 Drawing Figures

SCROLL FLUID APPARATUS WITH AN ARCUATE RECESS ADJACENT THE STATIONARY WRAP

BACKGROUND OF THE INVENTION

This invention relates to a scroll fluid apparatus, and, more particularly, to a scroll compressor, a scroll expander, a scroll pump, etc.

Generally, a scroll fluid apparatus comprises two scroll members each having an end plate and an upstanding wrap of a vortical form disposed on a surface of the end plate, with the two scroll members being arranged such that the wraps are in meshing engagement with each other. One of the two scroll members is capable of moving in orbiting movement with respect to the other scroll member while the one scroll member is prevented from rotating on its own axis whereby a gas is compressed or expanded to produce a motive force or transfer a liquid.

A scroll type fluid apparatus of the aforementioned type is disclosed, for example, in U.S. Pat. No. 801,182.

In, for example, U.S. Pat. No. 4,216,661 a fluid scroll apparatus of the aforementioned type is proposed wherein machining of the outer wall surface of the wrap of the stationary scroll member substantially for an extent of 180 degrees is unnecessary.

In a construction of the last-mentioned type, the time required for working the stationary scroll member can be shortened since there is no need to machine the outer wall surface of the wrap for an extent substantially of 180 degrees; however, a disadvantage of such construction resides in the fact that the surface normally machined contacts the end plate of the orbiting scroll member and the surface opposite thereto does not contact the end plate of the orbiting scroll member. Thus, the pressure acting on the orbiting scroll member becomes unbalanced, causing an unstable orbiting movement of the orbiting scroll member thereby giving rise to a problem of inducing vibration to occur in the orbiting scroll member.

Also, when the orbiting movement of the orbiting scroll member becomes unstable, it is impossible to keep the scroll fluid apparatus functioning at high efficiency for a prolonged period of time because the axial sealing of the orbiting scroll member and the stationary scroll member is adversely affected.

SUMMARY OF THE INVENTION

An object of this invention is to provide a fluid scroll apparatus in which an evenly distributed pressure can be applied to the orbiting scroll member.

Another object of the present invention resides in providing a scroll fluid apparatus in which vibration is minimized.

Still another object of the present invention resides in providing a scroll fluid apparatus in which the orbiting movement of the orbiting scroll member is stabilized.

A further object of the present invention resides in providing a fluid scroll apparatus having high volumetric efficiency.

Yet another object of the present invention resides in providing a scroll fluid apparatus in which the time required for fabricating the two scroll members is shortened.

Still another object of the present invention resides in providing a scroll fluid apparatus in which adverse thermal influences exerted on suction gas are small.

A further object of the present invention resides in providing a scroll fluid apparatus in which an axial sealing of a high order can be provided to the two scroll members.

In accordance with advantageous features of the invention an outer wall surface of a terminating end portion of the wrap of one scroll member is formed as a land which is contiguous with an annular portion surrounding the wrap, with the contiguous land portion being provided with a recess. Preferably, the recess has a minimal depth so long as the action thereof of rendering the pressure distribution of the fluid uniform is not adversely affected, since the smaller the depth of the recess, the shorter the time required for forming the recess. More importantly when the recess has a small depth, the fluid does not flow in and through the recess thereby avoiding a transfer of heat from the scroll members to the fluid which occur when the fluid flows in and through the recess. By virtue of these features, it is possible to maintain a high level volumetric efficiency. By providing a partition wall midway in the longitudinal direction of the recess it is possible to completely prevent a flow of the fluid in and through the recess.

DESCRIPTION OF THE PREFERRED EMBODIMENTS

Figure 1:
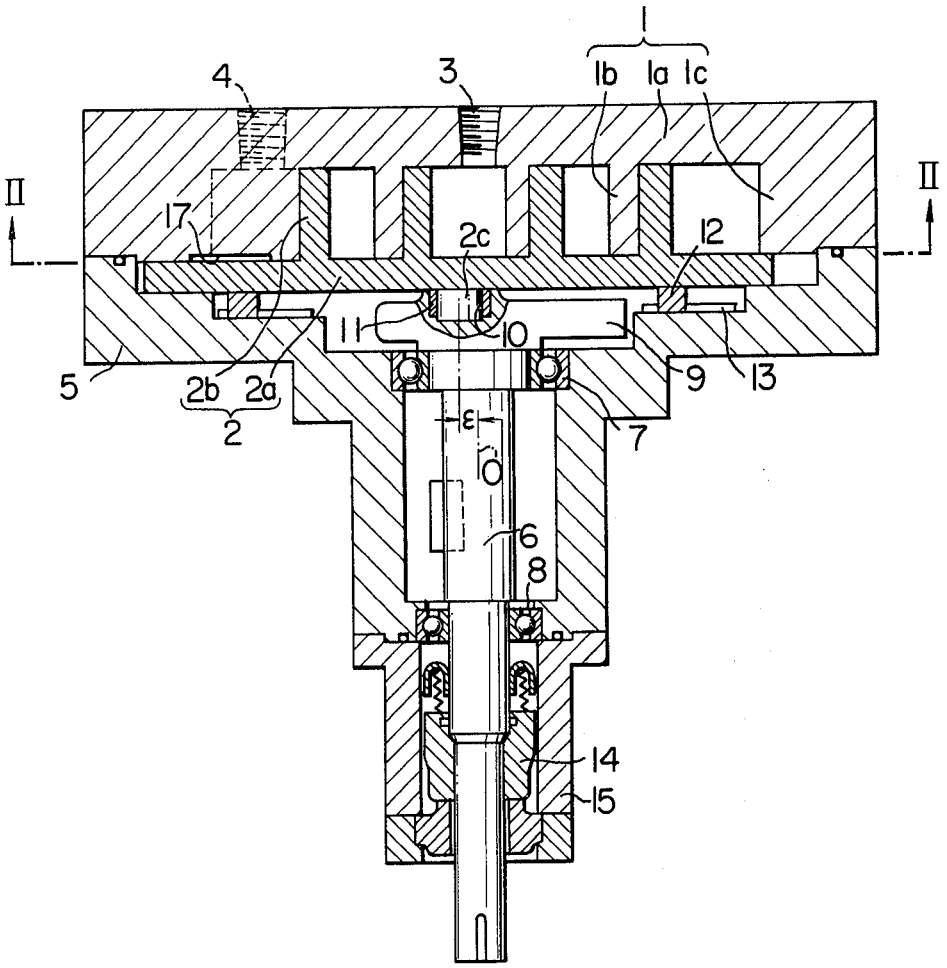
FIG. 1 is a vertical cross-sectional view of a first embodiment of a scroll fluid apparatus, taken along the line I—I in FIG. 2.
Figure 2:
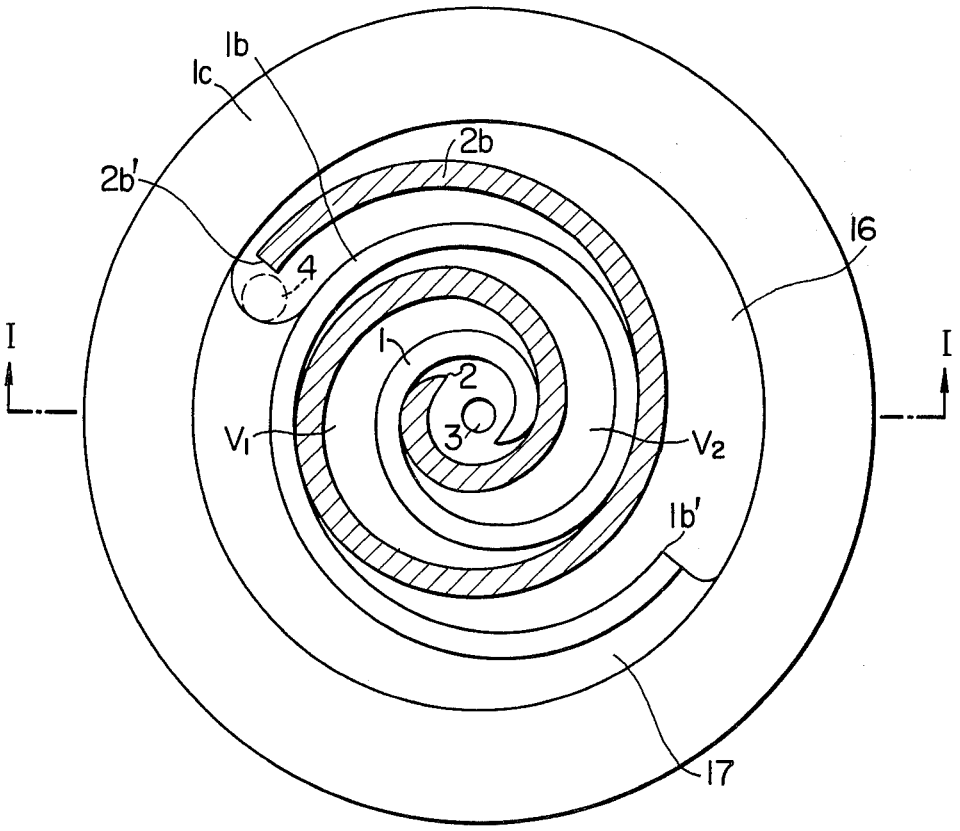
FIG. 2 is a cross-sectional view taken along the line II—II in FIG. 1.

Referring now to the drawings wherein like reference numerals are used throughout the various views to designate like parts and, more particularly, to FIGS. 1 and 2, according to these figures, a stationary scroll member generally designated by the reference numeral 1 includes an end plate 1*a*, and an upstanding vortical wrap 1*b* located on the surface of the stationary scroll member 1, and an annular portion 1*c* formed in a manner so as to surround the wrap 1*b*. An orbiting scroll member generally designated by the reference numeral 2 includes an end plate 2*a* of the disc form, and an upstanding wrap 2*b* of the same shape as the wrap 1*b* located on the surface of the end plate 2*a*. The wraps 1*b*, 2*b* of the scroll members 1, 2 are in the form of an involute or a similar curve and have the same thickness and height. The orbiting scroll member 2 has a scroll pin 2*c* projecting from a back surface thereof.

A port 3 is formed in the center of the end plate 1*a* of the stationary scroll member 1, and another port 4 is formed in an outer peripheral portion thereof. The port 3 serves as an outlet port when the apparatus functions as a compressor and as an inlet port when the apparatus functions as an expander.

The two scroll members 1 and 2 are arranged so that the surfaces of the end plates 1*a* and 2*a* face each other, and the wraps 1*b*, 2*b* are in meshing engagement with each other. With the wraps 1*b*, 2*b* in this condition, terminating ends 1*b*', 2*b*' of the wraps 1*b* and 2*b*, respectively, are positioned relative to each other in such a manner that they are spaced apart substantially for a circumferential extent of 180 degrees.

A frame 5 is bolted in several positions to an end face of the annular portion 1*c* of the scroll member 1. A crank shaft 6 is supported by the frame 5 through two sets of bearings 7 and 8 secured to the frame 5. A balance weight 9 is integrally formed with the crank shaft 6; however, the balance weight 9 may also be formed as a separate entity independent of the crank shaft 6.

A head of the crank shaft 6 is formed with a hollow boss 10 centered in a position displaced from a center axis O of the crank shaft 6 a distance E, with the scroll pin 2*c* being accommodated in the hollow boss 10. A needle bearing 11 is mounted between the hollow boss 10 and the scroll pin 2*c*.

A rotation preventing member 12 is mounted between the undersurface of the end plate 2*a* of the orbiting scroll member 2 and the frame 5. The rotation preventing member 12, is in the form of a ring formed with straight grooves (not shown) on a surface thereof juxtaposed against the end plate 2*a* and on a surface juxtaposed against the frame 5, respectively. The groove formed on the surface juxtaposed against the frame 5 crosses at a right angle to the groove formed on the surface juxtaposed against the end plate 2*a*. The groove formed on the surface juxtaposed against the frame 5 has a key 13 fitted therein secured to the frame 5, and the groove formed on the surface juxtaposed against the end plate 2*a* has a key (not shown) fitted therein which is also secured to the end plate 2*a*.

A conventional mechanical seal 14 is arranged at a portion of the crank shaft 6 extending through and outwardly of the frame 5, with the seal being contained in a seal housing 15. In operation, a rotation of the crank shaft 6, clockwise in FIG. 2, by means of a prime mover (not shown) causes the orbiting scroll member 2 to move in orbiting movement in a clockwise direction while not changing its posture, that is, not apparently rotating on its own axis, with respect to the stationary scroll member 1. As a result, the sealed spaces $V_1$, $V_2$ defined between the two scroll members 1, 2, have their volumes reduced while rotating in the clockwise direction, so as to compress fluid introduced therein through the port 4 and discharge the same through the port 3.

When the orbiting scroll member 2 moves in orbiting movement in a counterclockwise direction, as viewed in FIG. 2, the sealed spaces $V_1$, $V_2$ have their volumes gradually increased as they rotate in the counterclockwise direction, so that the gas of high temperature and pressure, as compared with the gas discharged through the port 4, introduced through the port 3 is expanded and discharged through the port 4. At this time, a motive force is generated at the crank shaft 6 and, when the number of turns of the vortices is 1.5, to eliminate any change in the volumes of the sealed spaces, the apparatus functions as a pump.

As shown in FIG. 2, a relief 16 is provided which extends from the terminating end 1*b*′ of the wrap 1*b* of the stationary scroll member 1 for a circumferential extent of about 180 degrees, so that there is no interference in the orbiting movement of the orbiting scroll member 2 nor does the wrap 2*b* strike an inner wall surface of the annular portion 1*c*. The relief 16 serves as a passage of a low pressure and low temperature gas when the apparatus functions as a compressor or an expander. A recess 17 of a strip form and a small depth, and communicating with the reflief 16, is provided and extends through a circumferential extent of 180 degrees which makes up a complete circle with the aforesaid circumferential extent of 180 degrees while leaving alone the wrap 1*b* of the stationary scroll member 1. The proper depth of the shallow recess 17 is less than 2 mm. By this construction, the fluid acting on the orbiting scroll member 2 has a pressure distribution which is of a point symmetry, thereby enabling a moment applied to the orbiting scroll member 2 by a biased pressure distribution to be reduced. The fluid flowing in and through the shallow recess 17 leaks into the relief 16 under the influences exerted by heat from the wall. Since the volume of such leaking fluid is very small as compared with the flow rate of fluid drawn by suction and discharged, a rise in the temperature of gas within the relief 16 caused to occur by the gas flowing in and through the recess 17 and leaking into the relief 16 is so small that it is negligible. Thus, the fluid machine obtained is advantageously low in vibration and thermal loss.

Figure 3:
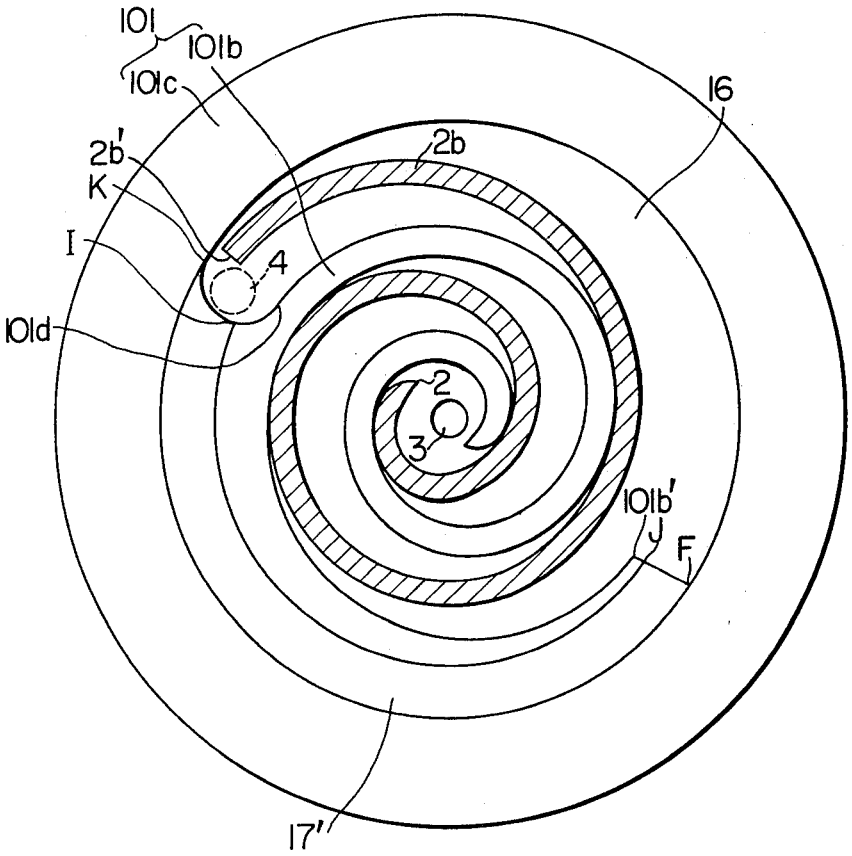
FIG. 3 is a cross-sectional view of another embodiment of a scroll fluid apparatus in accordance with the present invention, taken along a line II—II in FIG. 1.

As shown in FIG. 3 shallow recess 17′ is provided which is of an arcuate form with curves KF and IJ being arranged as concentric arcs. The outer involute curve of the stationary scroll member 101 terminates at a point 101*d*, and a curve 101*d*, with the curve being of any form as desired. Thus, the construction of FIG. 3 differs from the embodiment of FIGS. 1 and 2 in that the curve IJ is arcuate in shape. The construction of FIG. 3 offers the advantage that a working of the scroll member 1 to form the recess 17′ is facilitated.

Figure 4:
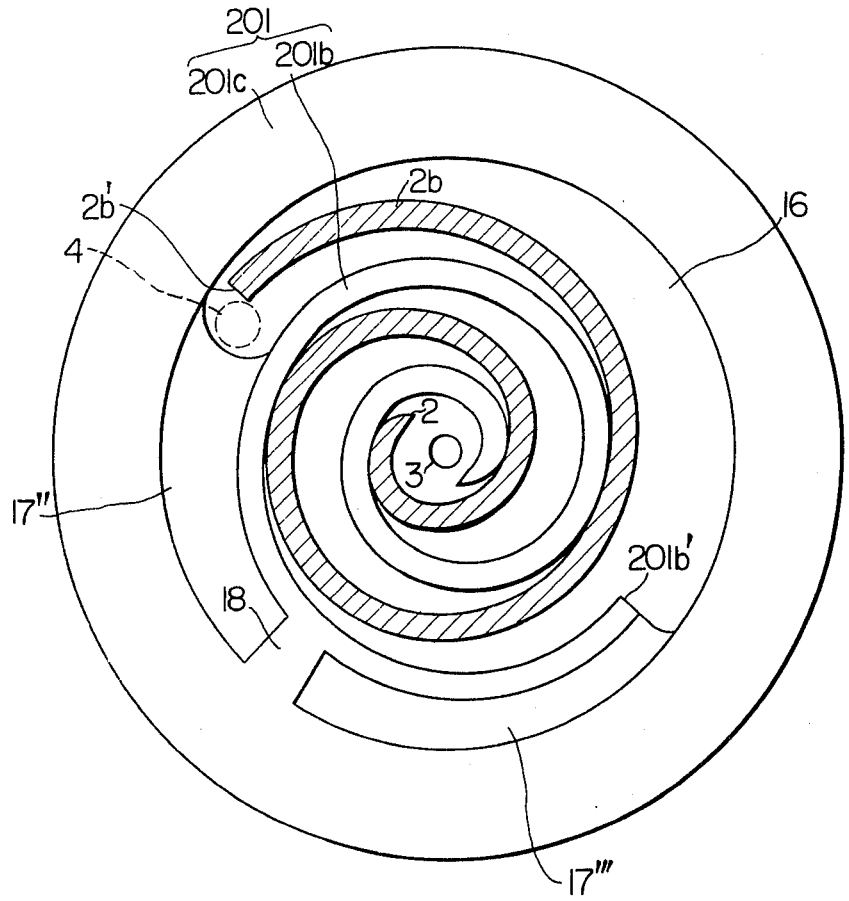
FIG. 4 is a cross-sectional view of yet another embodiment of a scroll fluid apparatus, taken along a line II—II in FIG. 1.
Figure 5:
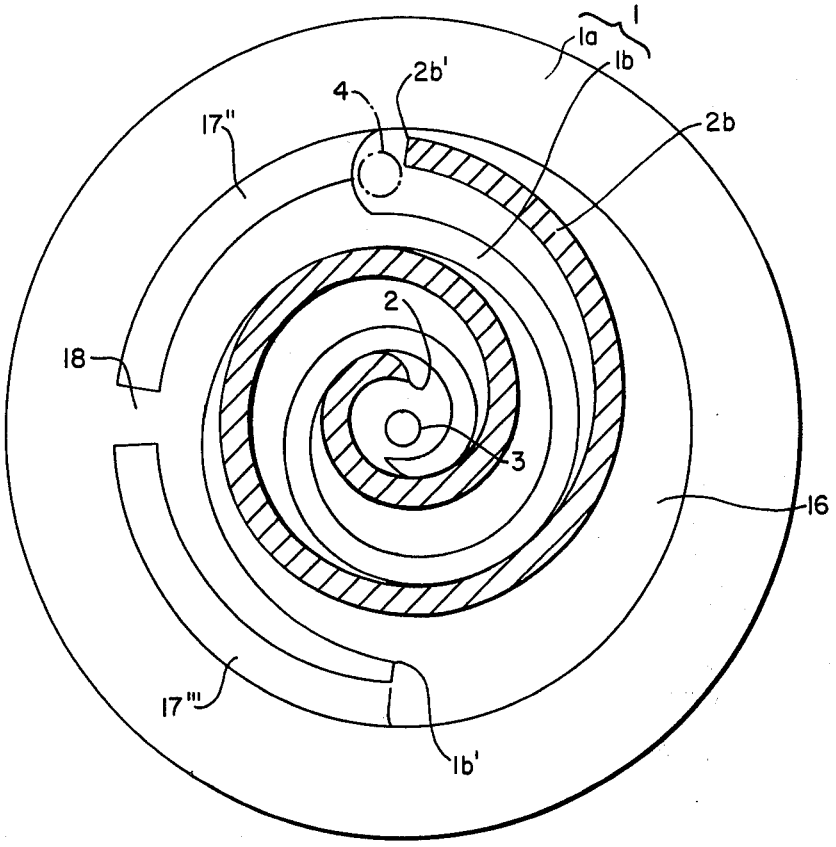

In FIG. 4 a partition wall 18 is provided midway in a strip-shaped recess formed on the outer side of circumferential extent of 180 degrees extending from the terminating end of the wrap of the stationary scroll member 201, with the partition wall 18 serving to break up or divide the recess into two recess sections 17″ and 17‴. The partition wall 18 connects the wrap 201*b* of the stationary scroll member 201 to the annular portion 201*c*. In this case, the depth of the recess sections 17″ and, 17‴ may be over 2 mm. Also, the recess sections 17″ and, 17‴ may have a depth which corresponds to the height of the wrap 201*b*, and the recess sections 17″ and, 17‴ may have different depths. In this embodiment, wherein the recess sections 17″ and, 17‴ may have many modifications, the fluid acting on the surface of the end plate of the orbiting scroll member on which the wrap is located has a pressure distribution which is substantially of point symmetry. In this respect, the point on which the point symmetry is based is located on the line connecting a center of the stationary scroll member 201 to a center of the orbiting scroll member 2 and in a position on such line which is equidistantly spaced apart from the two centers.

Thus, an axially oriented force acts substantially uniformly on the orbiting scroll member, so that the orbiting scroll member is capable of moving in orbiting movement in stable condition. As a result, vibration is eliminated. The existence of the partition wall 18 has the effect of preventing the flow of the fluid in and through the recess toward the sealed spaces $V_1$, $V_2$, so that the path of flow of gas through the port 4 to the sealed spaces $V_1$, $V_2$ is by way of the relief 16. This minimizes the length of flow of the gas, and hence it is possible to minimize the amount of heat transferred from the wall surfaces of the relief 16 and the recess 17″, 17‴, thereby enabling volumetric efficiency to be maintained at a high level.

What is claimed is:

1. A scroll fluid apparatus comprising: a first scroll member including an end plate and an upstanding wrap of vortical form located on a surface of said end plate, said wrap having a predetermined thickness and height, a second scroll member including an end plate and an upstanding wrap of vortical form located on a surface of said last-mentioned end plate, said wrap of said second scroll member having a predetermined thickness and height, said second scroll member having an annular portion one with the end plate thereof and surrounding the wrap of said second scroll member, the first and second scroll members being disposed such that said annular portion contacts the end plate of said first scroll member and said first scroll member moves in orbiting motion with respect to said second scroll member, the annular portion of said second scroll member has a height corresponding to the height of the wrap thereof and is continguious at a surface thereof formed as a land with a surface of the wrap of the second scroll member for a circumferential extent of 180° from a terminating end of the wrap of the second member, said land having a strip-shaped recess defined on a radially outer side thereof by a section of the annular portion and on a radially inner side thereof by a portion of the wrap of the second scroll member, a depth of said recess is less than a height of the wrap of the second scroll member and said radially outer side of the recess is located at a predetermined distance from an outer wall surface of the wrap of the second scroll member, said recess communicating with a low pressure zone through an end portion thereof.

2. A scroll fluid apparatus as claimed in claim 1, wherein said recess has a uniform depth.

3. A scroll fluid apparatus as claimed in claim 2, wherein the depth of said recess is less than 2 mm.

4. A scroll fluid apparatus as claimed in one of claims 1 or 2, wherein a curve defining the outer side of the recess is arcuate.

5. A scroll fluid apparatus as claimed in claim 4, wherein a curve defining the inner-side boundary of the recess is a curve parallel to an inner wall surface of the wrap.

6. A scroll fluid apparatus is claimed in claim 4, wherein a curve defining the inner-side boundary of the recess of the strip form is arcuate.

7. A scroll fluid apparatus comprising two scroll members each including an end plate and a wrap of vortical form located in an upstanding position on a surface of said end plate, the two scroll members being arranged in combination such that the surfaces of the end plates are juxtaposed against each other and the wraps of the two scroll members are in meshing engagement with each other whereby one of the two scroll members moves in an orbiting movement with respect to the other scroll member while rotation on its own axis is prevented, the improvement comprising an annular portion disposed on the outer side of the wrap of the other of said scroll members and having a height corresponding to a height of the wrap thereof, said annular portion being contiguous at a surface thereof formed as a land with a surface of the wrap of the other of said scroll members for a circumferential extent of 180° from a terminating end of said wrap, a strip-shaped recess formed in the land and having an end portion communicating with a low pressure zone surrounded by said annular portion, and a partition wall means disposed substantially midway in a longitudinal extent of the recess for dividing the recess into two recess sections, said partition wall means has a height which is the same as the height of the annular portion and the height of the wrap at its surface.

8. A scroll fluid apparatus as claimed in claim 7, wherein the two recess sections each have a depth which is less than 2 mm.

9. A scroll fluid apparatus as claimed in claim 7, where a curve defining an outer-side boundary of the recess is arcuate, and a curve defining an inner-side boundary of the recess is a curve parallel to an inner wall surface of the wrap.

10. A scroll fluid apparatus comprising:

a stationary scroll member including an end plate, an upstanding wrap of vortical form located on a surface of said end plate, said wrap having a thickness and a height, and an annular portion located on an outer side of said wrap in a manner so as to surround the wrap, said annular portion having a height corresponding to a height of the wrap and being contiguious at a surface formed as a land with a surface of the wrap for a circumferential extent within 180 degrees from a terminating end of the wrap, said land having a strip-shaped recess defined on a radially outer side thereof by a section of the annular portion and on a radially inner side thereof by a portion of the wrap, a depth of said recess being less than a height of said wrap, and said radially outer side of said recess is located at a predetermined distance from an outer wall surface of the wrap, said recess communicating with a low pressure zone through an end portion thereof, said end plate of said stationary scroll member being formed at a central portion thereof with a high pressure port and at an outer peripheral portion with a low pressure port;

an orbiting scroll member including an end plate and an upstanding wrap of vortical form located on a surface of said last-mentioned end plate and having a predetermined thickness and height, said orbiting scroll member being in meshing engagement with said stationary scroll member;

a frame connected to the surface of said annular portion of the stationary scroll member;

a least two sets of bearings mounted on said frame and disposed in spaced relationship;

a crankshaft journaled by said bearings and associated with said orbiting scroll member in such a manner so as to receive a motive force for rotation transmitted alternately to the crankshaft and the orbiting scroll member; and a rotation preventing means interposed between said stationary scroll member and said orbiting scroll member for preventing the orbiting scroll member from rotating on its own axis.

11. A scroll fluid apparatus comprising:

a stationary scroll member including an end plate, an upstanding wrap of vortical form located on a surface of said end plate, said wrap having a thickness and a height, and an annular portion located on an outer side of said wrap in a manner so as to surround the wrap, said annular portion being contiguous at a surface formed as a land with a surface of the wrap for a circumferential extent of within 180 degrees from a terminating end of the wrap, said land being formed therein with a strip-shaped recess, said end plate of said stationary scroll member being formed at a central portion thereof with a high pressure port and at an outer peripheral portion with a low pressure port;

an orbiting scroll member including an end plate, an upstanding wrap of vortical form located on a surface of said last mentioned end plate and having a predetermined thickness and height, said orbiting scroll member being in meshing engagement with said stationary scroll member;

a frame connected to the surface of said annular portion of said stationary scroll member;

at least two sets of bearings mounted on said frame and disposed in a spaced relationship;

a crankshaft journaled by said bearings and associated with said orbiting scroll member in such a manner so as to receive a motive force for rotation transmitted alternately to the crank shaft and the orbiting scroll member;

a rotation preventing means interposed between said stationary scroll member and said orbiting scroll member for preventing the orbiting scroll member from rotating on its own axis; and a partition wall means disposed substantially midway in a longitudinal extent of said strip-shaped recess for dividing the recess into two recess sections.

12. A scroll fluid apparatus as claimed in one of claims 10 or 11, wherein a curve defining the outer-side of the strip-shaped recess is arcuate.

13. A scroll fluid apparatus as claimed in claim 12, wherein a curve defining the inner-side of the strip-shaped recess is arcuate and concentric with an arc defining the outer-side thereof.

14. A scroll fluid apparatus as claimed in claim 12, wherein a curve defining the inner-side boundary of the recess of the strip form is a curve parallel to the inner wall surface of the wrap.

* * * * *